US007621631B2

(12) United States Patent
Tsao

(10) Patent No.: US 7,621,631 B2
(45) Date of Patent: Nov. 24, 2009

(54) ENHANCING COLOR SPACE OF REACTIVE INK USING HEAT

(75) Inventor: Yi-Hua Tsao, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 223 days.

(21) Appl. No.: 10/771,832

(22) Filed: Feb. 4, 2004

(65) Prior Publication Data

US 2005/0168554 A1 Aug. 4, 2005

(51) Int. Cl.
*B41J 2/01* (2006.01)

(52) U.S. Cl. ..... 347/102; 347/101; 347/100

(58) Field of Classification Search ..... 347/100–102, 347/95–97; 106/31.13, 31.2, 31.6, 31.27
See application file for complete search history.

(56) References Cited

U.S. PATENT DOCUMENTS 5,062,892 A 11/1991 Halko
5,062,893 A 11/1991 Adamic et al.
5,568,173 A * 10/1996 Leenders et al. ..... 347/96
5,614,007 A 3/1997 Kurabayashi et al.
5,679,724 A 10/1997 Sacripante et al.
5,782,967 A 7/1998 Shirota et al.
5,792,249 A 8/1998 Shirota et al.
5,795,376 A 8/1998 Ide
6,013,123 A 1/2000 Scarpetti
6,106,113 A 8/2000 Yamazaki et al.
6,254,669 B1 7/2001 Lavery et al.
6,261,350 B1 * 7/2001 Kabalnov ..... 106/31.33
6,406,138 B1 * 6/2002 Gore ..... 347/96
6,443,568 B1 9/2002 Askeland et al.
6,503,978 B1 1/2003 Tsao et al.
6,585,364 B2 * 7/2003 Kasperchik et al. ..... 347/98
6,607,266 B2 8/2003 Katsuragi et al.
2003/0022094 A1 1/2003 Nakamura et al.
2003/0070581 A1 4/2003 Tomioka et al.
2003/0071259 A1 4/2003 Yoshida
2003/0079652 A1 5/2003 Choy
2003/0103121 A1 6/2003 Tomioka et al.

FOREIGN PATENT DOCUMENTS

EP 1 308 491 A2 5/2003

* cited by examiner

*Primary Examiner*—Manish S Shah

(57) ABSTRACT

The present invention includes a method of enhancing color space of dye-based ink. The print zone is heated while depositing fixer fluid and dye-based ink. In an embodiment, the print zone is heated to a temperature between about 45° C. and 85° C. The fixer fluid may be underprinted and/or overprinted. Printing may be effected using any desired print mode, including one-pass, two-pass or four-pass.

17 Claims, 12 Drawing Sheets

ENHANCING COLOR SPACE OF REACTIVE INK USING HEAT

BACKGROUND OF THE INVENTION

Inkjet printing is a popular alternative for home and office printing due to the low cost of inkjet printers, advances in quality of the printed images, and relative noise-free operation. Recent developments in inkjet technology allow consumers to use inkjet printing for creating traditional documents on "plain paper" or non-glossy media as well as creating high quality images or brochures on glossy media. Research and development of inkjet printing continues in order to improve inkjet print quality while maintaining a reasonable cost for the inkjet printer and the printing process.

To print color images, inkjet printing uses a combination of cyan, magenta, yellow, and, optionally, black, light cyan, and light magenta inkjet inks to produce the colors of a color spectrum. Color inkjet inks are typically aqueous-based and are formulated by dissolving or dispersing a colorant, such as a dye or pigment, in an aqueous ink vehicle. The ink vehicle comprises additional components depending on the application and desired properties of the color inkjet ink, as known in the art. Water based inks are generally preferred in the inkjet printing industry because water is readily available at low cost, chemically unreactive, non-toxic and environmentally friendly.

However, water-based inks are potentially limited in waterfastness of the printed image. The colorant is not immobilized so that when the printed image encounters water the image is degraded. Thus, there is a desire to develop methods that will increase the waterfastness of the aqueous based inks.

To address shortcomings of water-based inks, methods have been developed in which a "fixer" is deposited on the print media either prior to or after the deposition of ink. Fixer typically includes components that reduce colorant mobility and react with the colorant present in the inks to produce an insoluble fixer-colorant complex, which makes the image more waterfast.

While fixer may be used with a dye-based color ink system to provide durability, it tends to precipitate the dye quickly, reducing dot gain and resulting in lower chroma. Thus, it can be appreciated that improvements are still needed in the inkjet printing process.

BRIEF SUMMARY OF THE INVENTION

The present invention relates to a method of enhancing color space of reactive ink using heat. A heated print zone is employed to compensate for the decrease in color space that occurs when a fixer is used during printing. A print zone is heated during deposition of fixer fluid and dye-based ink. In one embodiment, the print zone is heated to a temperature between about 45° C. and 85° C.

The present invention also includes a printing system capable of maintaining or enhancing chroma independent of increased ink application. The system includes a print zone configured to be heated up to about 85° C. and a pen set configured to apply dye-based ink and fixer to a print medium in the heated print zone.

BRIEF DESCRIPTION OF THE SEVERAL VIEWS OF THE DRAWINGS

While the specification concludes with claims particularly pointing out and distinctly claiming that which is regarded as the present invention, the present invention can be more readily ascertained from the following description of the invention when read in conjunction with the accompanying drawings in which:

DETAILED DESCRIPTION OF THE INVENTION

Figure 1:
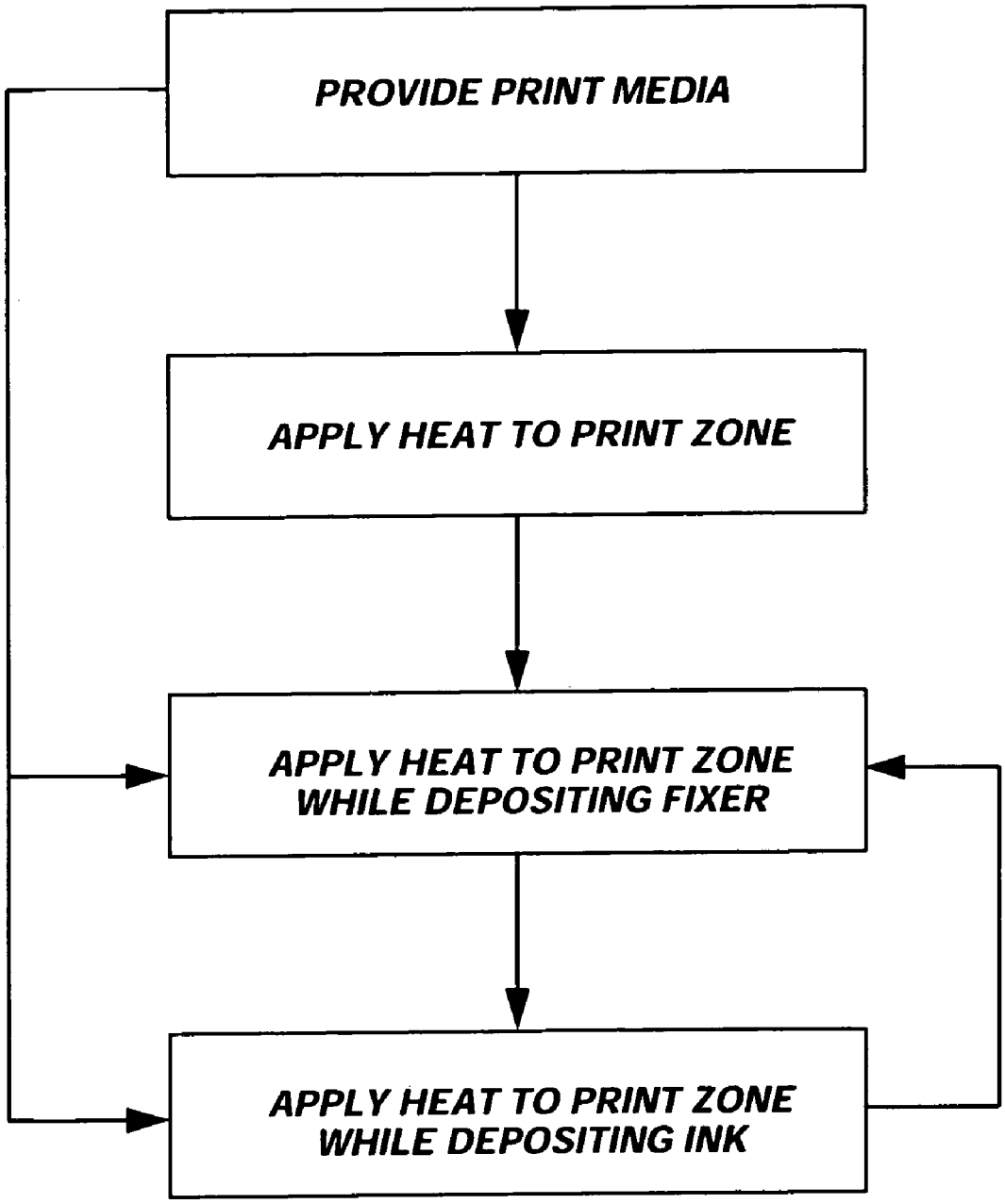
FIG. 1 is a flow chart depicting an embodiment of a method of the present invention.

The present invention provides a color system for inkjet printing that exhibits enhanced color space. Fixer may be used with a dye-based color ink system to provide durability. However, fixer tends to precipitate the dye quickly, reducing dot gain resulting in lower chroma. The present invention provides enhanced color space by applying heat during printing.

As used herein, "dot gain" refers to the net percent increase in halftone dot size over the initial, spherical drop diameter. "Chroma" refers to the attribute of color used to indicate the degree of departure of the color from a gray of the same lightness (ASTM E 284). "Print mode" refers to the number of passes printing. An n-pass print mode corresponds to putting down 1/n of a fixed amount of ink and fixer in the same pass. The process is repeated "n" times during printing. Fixer may be printed before or after the inks are printed.

Ink and Fixer Compositions

In one particular embodiment, a fixer is used in combination with dye-based ink during the printing process. "Fixers" are generally materials that may be applied beneath a colored ink drop (pre-coats or undercoats) and materials that may be applied over a colored ink drop (post-coats or overcoats). The fixers often consist of a cationic polymer and are used to reduce colorant mobility or "fix" ink on a print medium.

The ink and fixer compositions of the present invention may comprise standard dye-based or pigment based inkjet ink and fixer solutions. As a non-limiting example, the fixer may comprise a water-based solution including acids, salts and organic counter ions and polyelectrolytes. The fixer may comprise other components such as biocides that inhibit growth of microorganisms, chelating agents (e.g., EDTA) that eliminate deleterious effects of heavy metal impurities, buffers, ultraviolet absorbers, corrosion inhibitors, and viscosity modifiers, which may be added to improve various properties of the ink and fixer compositions.

In another embodiment, the fixer includes a component that reacts with the ink. The component may have a charge opposite to the charge of the ink. For instance, if the ink is anionic, the fixer may include a cationic component. In addition, the fixer may be substantially devoid of a colorant or may include a colorant that does not absorb visible light.

The fixer fluid may also include a precipitating agent, such as a salt or an acid. The salt may include cations, such as calcium, magnesium, aluminum, or combinations thereof. The salt may include, but is not limited to, calcium nitrate, magnesium nitrate, or ammonium nitrate. The acid may be any mineral acid or an organic acid, such as succinic acid or glutaric acid. The precipitating agent may be used to change the conductivity or the pH of the ink, causing the pigment in the ink to precipitate on the surface of the print medium. The fixer may be over-printed and/or under-printed on the print medium relative to the ink. As such, the fixer fluid may be present in an additional pen in the printer, such as a fifth pen.

Print Medium

The print medium upon which the inkjet ink and/or fixer may be deposited may be any desired print medium. In a particular embodiment, the print media may be a plain print medium or a commercially coated brochure print medium. Plain print media are known in the art and may include, but are not limited to, Hammermill® Fore DP paper, produced by International Paper Co. (Stamford, Conn.) and HP Multi-Purpose paper, produced by Hewlett-Packard Inc. (Palo Alto, Calif.). Commercially coated brochure print media, such as the type used to print brochures or business flyers, are also known in the art and are typically hydrophobic and non-porous or less porous than plain paper, including "Lustro Laser", produced by SD Warren Company (Muskegon, Mich.).

The ink may be deposited on the print medium by a conventional inkjet printing technique. For instance, the ink may be deposited by an inkjet printer, such as an HP DeskJet printer, available from Hewlett-Packard, Inc. (Palo Alto, Calif.). The ink may be deposited on the print medium, in combination with the fixer fluid.

Inkjet printing may involve the ejection of small droplets of ink onto a print medium in response to electrical signals generated by a microprocessor; Typically, an inkjet printer utilizes a pen set mounted on a carriage that is moved relative to the surface of the print medium. A pen set of the present invention may, for example, include five pens (cyan ink, magenta ink, yellow ink, black ink, and fixer). Each pen may include a print head with orifice plates that have very small nozzles (typically 10-50 μm diameter) through which the ink or fixer droplets are ejected. Adjacent to these nozzles are chambers where ink or fixer is stored prior to ejection.

Figure 2:
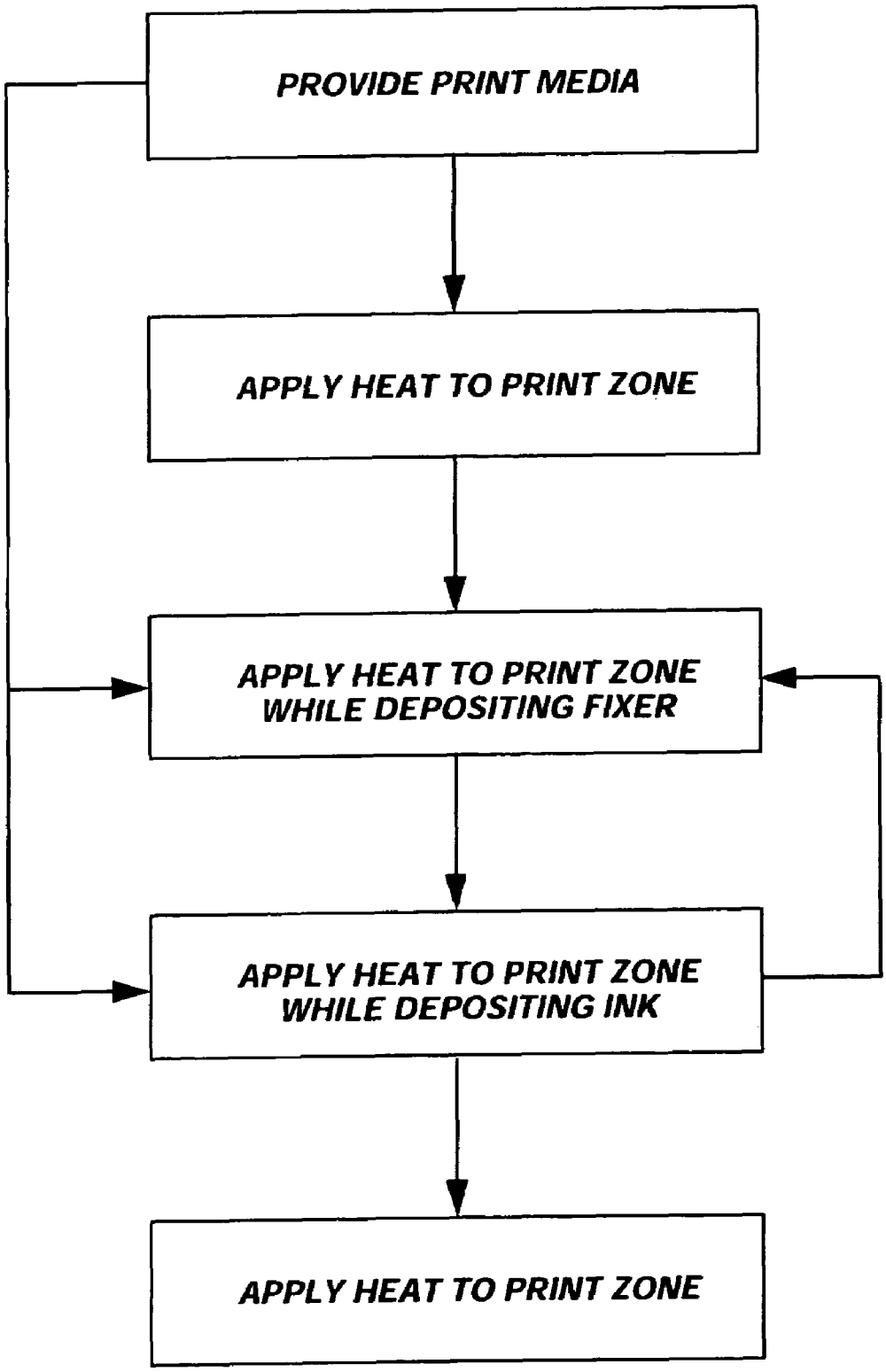
FIG. 2 is a flow chart depicting an optional post-printing heating step that may be included in the present invention.

In a particular embodiment, ink and fixer are placed in separate inkjet pens and deposited on the print medium on the same pass or different passes (see FIGS. 1 and 2). For example, the fixer may be used to undercoat the inks. Additionally or alternatively, the fixer can be used to overcoat the inks. If the printing is to be conducted in several passes the inks (I) and fixer (F) can be deposited in a multilayered fashion, (i.e., F-I-F-I-F-I). It will further be appreciated that inks of different color (e.g., cyan (C), magenta (M), and yellow (Y)) may be deposited on the same pass or different passes and that they may be deposited in a multilayered fashion with or without additional deposition of fixer, (i.e., C-M-Y, F-C-M-Y-F, F-C-F-M-F-Y-F, etc.). It will be understood that the fixer need not necessarily be deposited onto the print medium by inkjet printing methods. The fixer may, for example, be deposited on the print medium using rollers that have been impregnated with fixer.

The print zone is heated during the application of fixer and ink. In an embodiment, the print zone may also be heated before and/or after the deposition of fixer and/or inks (see FIGS. 1 and 2). The print zone may be heated by, for example, blowing hot air directly onto the print medium. Alternatively or additionally, the print zone could be heated by irradiation such as infra-red radiation or by using heated rollers. It will be appreciated that the print zone may also be pre-heated prior to ink and/or fixer deposition. To reduce drytime yet further, the print zone may also be heated for a fixed time once the inks and/or fixer have been deposited. It will be appreciated that the print zone may be heated in between ink and/or fixer deposition steps or alternatively the print zone may be further heated once all the ink and/or fixer deposition steps have been completed. In an embodiment, the print zone is heated from room temperature up to about 85° C. during printing.

EXAMPLES

The following examples illustrate that improved image quality and performance are achieved by heating the print zone during printing. The following examples should not be considered as limitations of the present invention, but should merely teach how to make the best-known image quality based upon current experimental data.

Example 1

Ink and Fixer Formulations

The ink and fixer formulations for Examples 2 through 5 were prepared as listed in Table 1, 2 and 3. The IR marker in the fixer was optional.

TABLE 1

Ink A and Fixer A formulations

| | C (wt %) | M (wt %) | Y (wt %) | K (wt %) | Fixer A |
|---|---|---|---|---|---|
| Copper Phthalocyanine dye | 2.0 | | | | |
| AB9 | 1.0 | | | | |
| Proprietary Magenta dye | | 2.0 | | | |
| AR289 | | 0.7 | | | |
| DY132 | | | 2.0 | | |
| AY23 | | | 1.0 | | |
| DB168) | | | | 4.0 | |
| Poly guanidine chloride | | | | | 4.0 |
| 2-pyrrolidinone | 11.5 | 11.5 | 11.5 | 7.5 | |
| Alkyl diol | | | | 6.5 | |
| 1,2 alkyl diol | 2.5 | 2.5 | 2.5 | | 7.5 |
| sulfolane | | | | | 7.5 |
| Oleyl triethoxy mono diphosphate | 0.5 | 0.5 | 0.5 | | |
| Fluorosurfactant | 0.15 | 0.15 | 0.15 | 0.15 | |
| 1,4-Bis(2-ethylhexyl) sulfosuccinate | 0.2 | 0.2 | 0.2 | 0.2 | |
| Triton X-45 | 0.35 | 0.35 | 0.35 | 0.15 | |
| Brij30 | | | | | 0.4 |
| Chelating agent | 0.1 | 0.1 | 0.1 | 0.1 | 0.05 |
| Biocide | 0.1 | 0.1 | 0.1 | 0.1 | |
| Buffer | 0.2 | 0.2 | 0.2 | 0.2 | |
| β-alanine | | | | | 0.2 |
| ph | 7.0 | 7.0 | 7.0 | 7.0 | 4.0 |

TABLE 2

Fixer B Formulation

| | Fixer B-IR |
|---|---|
| succinic acid | 4 |
| Nitric acid neutralized Lupasol FG | 2.5 |
| Biocide | 0.94 |
| 2-pyrrolidinone | 15 |
| Surfynol 61 | 0.25 |
| Acetylenic diol | 0.3 |
| Fluorosurfactant | 0.1 |
| Tinolux | 0.0015 |
| DI water to make up to 100 g | 76.9085 |
| pH | 4.0 |

DI = deionized water

TABLE 3

Ink B Formulations

| | Abs | Dilution | λmax | C | M | Y |
|---|---|---|---|---|---|---|
| AB9 dye (Na salt) | 0.093 | 10,000 | 630 nm | X | | |
| DB199 dye (Na salt) | 0.1 | 10,000 | 619 nm | X | | |
| AR52 dye (Na salt) | 0.181 | 10,000 | 565 nm | | X | |
| Magenta dye | 0.034 | 10,000 | 518 nm | | X | |
| AY23 dye (TMA) | 0.147 | 10,000 | 426 nm | | | X |
| Alkyl diol | | | | 11.8 | 11.8 | 11.8 |
| 2-pyrrolidinone | | | | 5.9 | 5.9 | 5.9 |
| Secondary alcohol ethoxylate | | | | 0.71 | 0.71 | 0.71 |
| Octyl dimethyl glycine | | | | 1.66 | 1.66 | 1.66 |
| tetraethylene glycol | | | | 3.3 | 3.3 | 3.3 |
| Oleyl triethoxy mono diphosphate | | | | 0.38 | 0.38 | 0.25 |

TABLE 3-continued

Ink B Formulations

| | Abs | Dilution | λmax | C | M | Y |
|---|---|---|---|---|---|---|
| Chelating agent | | | | 0.127 | 0.127 | 0.127 |
| Sodium hexadecyl dipheyloxide disulfonate | | | | 0.48 | 0.48 | 0.48 |
| Tris(hydroxymethyl) aminomethane | | | | 0.1 | 0.1 | 0.1 |
| pH | | | | 8.5 | 8.5 | 8.5 |

Example 2

Print Sample Generation

Images were printed at room temperature (25° C.) and at 85° C. using a modified HP business inkjet 2200 printer and inkjet pens with one-pass print mode. Inkjet pens (~7 μpI) were used to underprint fixer and print inks at 4 drops/300 dpi. The printer was operated under unheated (room temperature ((25° C.)) or heated (85° C.) conditions. Images were printed on Hammermill® Fore DP (plain paper) and Lustro Laser (a commercially coated brochure media), although ink B was not designed for printing on Lustro Laser. Images are printed using one-pass print mode unless noted otherwise. The ratio of the fixer to ink is one to one. "Fixer underprinting" refers to printing the fixer first followed by printing the same amount of ink.

Example 4

L*a*b* Testing

The L* a* b* values were measured using a commercial calorimeter and standard color measurement procedures. Any given perceived color can be described using any one of the color spaces, such as CIELAB, as is well known in the art. In the CIELAB color space, a color is defined using three terms L*, a*, and b*. L* defines the lightness of a color, and ranges from zero (black) to 100 (white). The terms a* and b*, together, define the hue. The term a* ranges from a negative number (green) to a positive number (red). The term b* ranges from a negative number (blue) to a positive number (yellow). a* and b* values were measured, as known in the art, using a commercial calorimeter and standard color measurement procedures. These values were used to calculate the projected area that a specific dye set can produce. The larger the area, the more colors the dye set is capable of producing.

Figure 3:
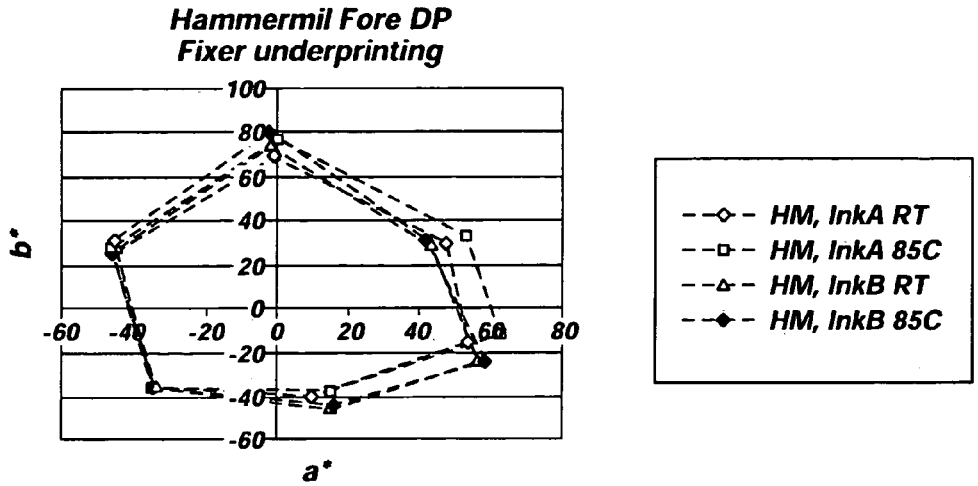
FIG. 3 depicts the projected L*a*b* area and the size of the projected area of ink A and ink B underprinted with corresponding fixers on plain paper and a commercially coated brochure paper at room temperature (RT) and at 85° C. according to an embodiment of the present invention.
Figure 3:
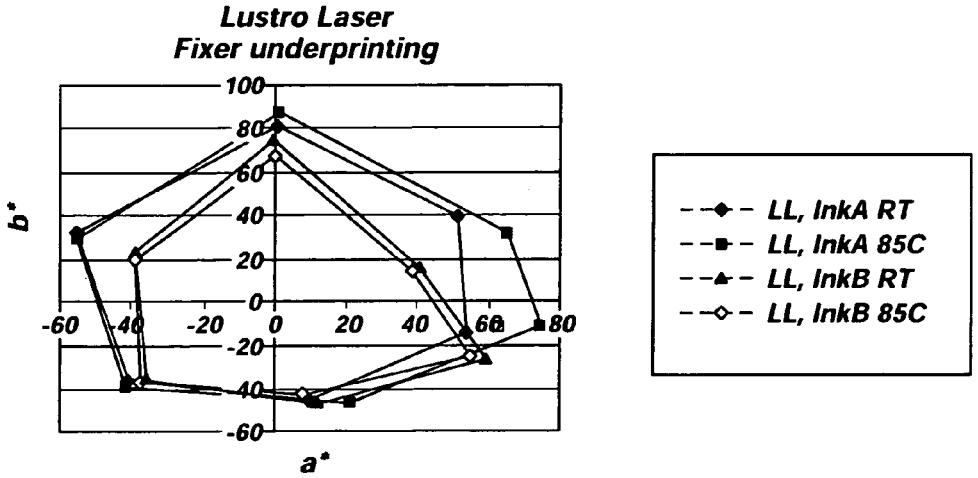
Figure 3:
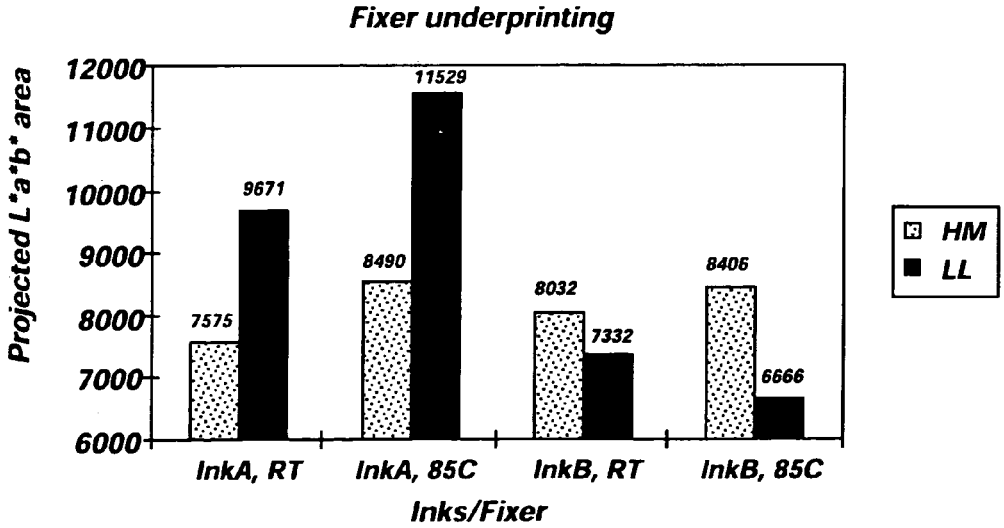

Projected L*a*b* area and the size of the projected area of ink A and ink B color inks/fixer is shown in FIG. 3. The largest projected area on plain paper was with ink A at 85° C. followed by ink B at 85° C. (FIG. 3, bottom panel). The largest projected area overall was ink A on commercially coated brochure media at 85° C. (FIG. 3, bottom panel). The projected area of ink A improved on both media at the increased temperature. Ink B was not designed for printing on commercially coated brochure media and did not demonstrate an increased projected area at the higher temperature on the commercially coated brochure media.

Example 6

Ink Formulation

The ink and fixer formulations for Examples 7-11 were prepared as listed in Table 1. The ink pH was adjusted to 7 with $NaOH/HNO_3$.

Example 7

Print Sample Generation

To determine the print quality, an image was printed using a modified HP business inkjet 2200 printer printed at 20 ips. The underprinting print mode was achieved by placing a fixer pen in the K slot, a color pen in the C slot and leaving the remaining slots empty. Standard inkjet inkpens (~7 pl) were used to print inks and fixer. The printer was operated under unheated conditions (25° C.), 45° C., 55° C. and 85° C. Plain paper (Hammermill® Fore DP) and a commercially coated brochure media (Lustro Laser) were used.

In the one-pass print mode, all the fixer and ink drops were fired in one-pass with fixer drops fired first. In the two-pass print mode, 50% of the fixer drops were fired immediately followed by 50% of the ink drops. The other half of the fixer and ink drops were fired in the same manner in a subsequent pass. In the four-pass print mode, 25% of the fixer drops were fired immediately followed by 25% of the ink drops. This process was repeated three times in subsequent passes.

Example 8

Single Color Image Quality and Results

The L* a* b* values were measured using a commercial calorimeter and standard color measurement procedures. Any given perceived color can be described using any one of the color spaces, such as CIELAB, as is well known in the art. In the CIELAB color space, a color is defined using three terms L*, a*, and b*. These values were used to calculate the volume of space that a specific dye set can produce. The larger the volume, the more colors the dye set is capable of producing. Thus, as used herein, "gamut volume" refers to the number of visually distinct colors that may be printed with a particular printing system.

For overall color performance, gamut volume is estimated from L* a* and b* using (X-Rite D50, 1931 CIE 2-degree observer) of 8 colors (CMYKRGBW). L* a* and b* values for black on both uncoated paper were assumed to be 29.32, −1.44 and 0.66. L* a* and b* values for black on all media coated paper were assumed to be 12.49, −0.05 and 2.18. These values were derived from separate measurements. The same values for black were used for 8-point estimation on samples printing at various temperatures.

Figure 4:
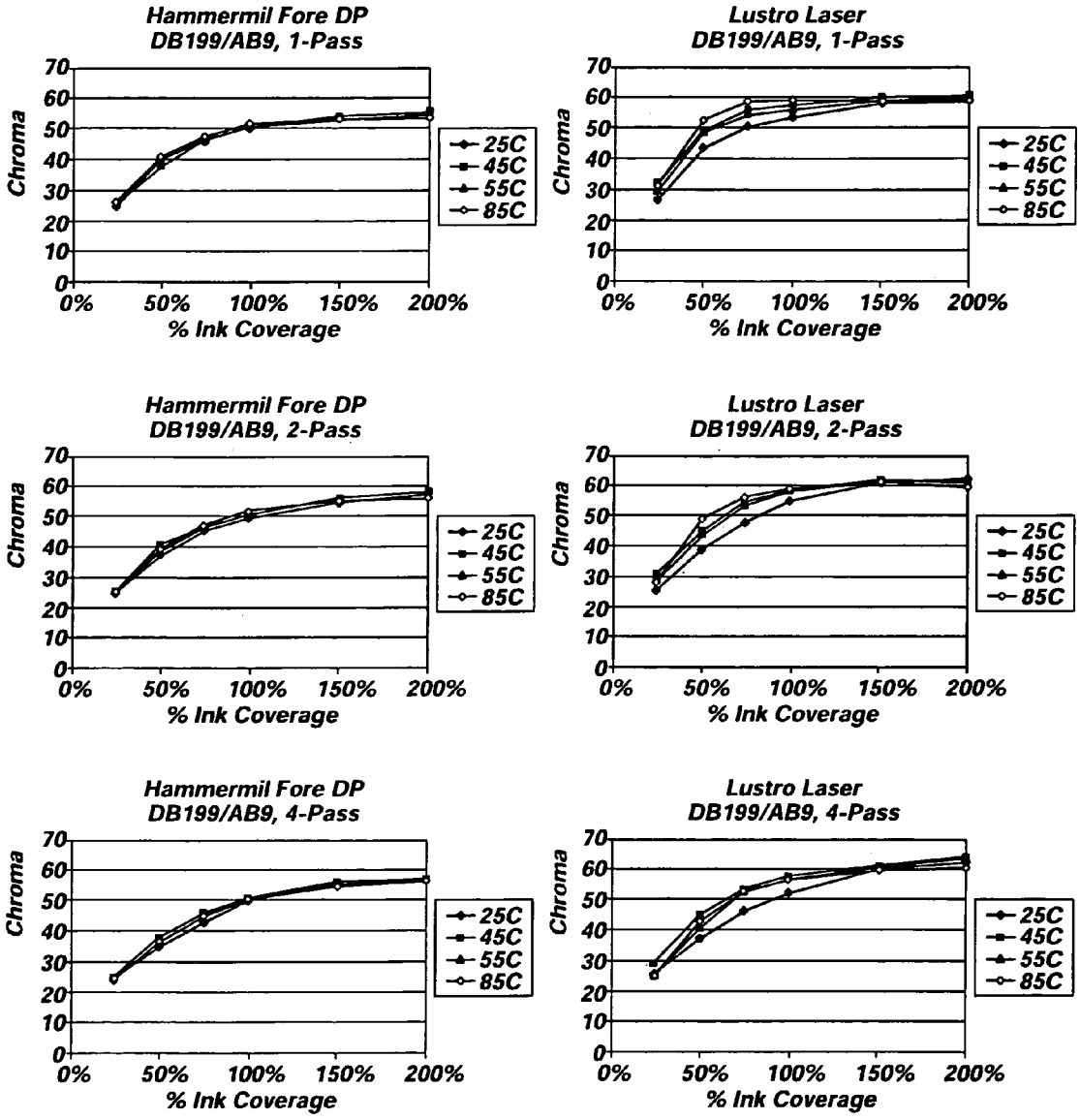
FIG. 4 shows cyan chroma as a function of percent ink coverage on plain paper (left column) and on a commercially coated brochure media (right column) according to an embodiment of the present invention. The effect on chroma with increasing number of passes printing at various print zone temperatures is shown.
Figure 5:
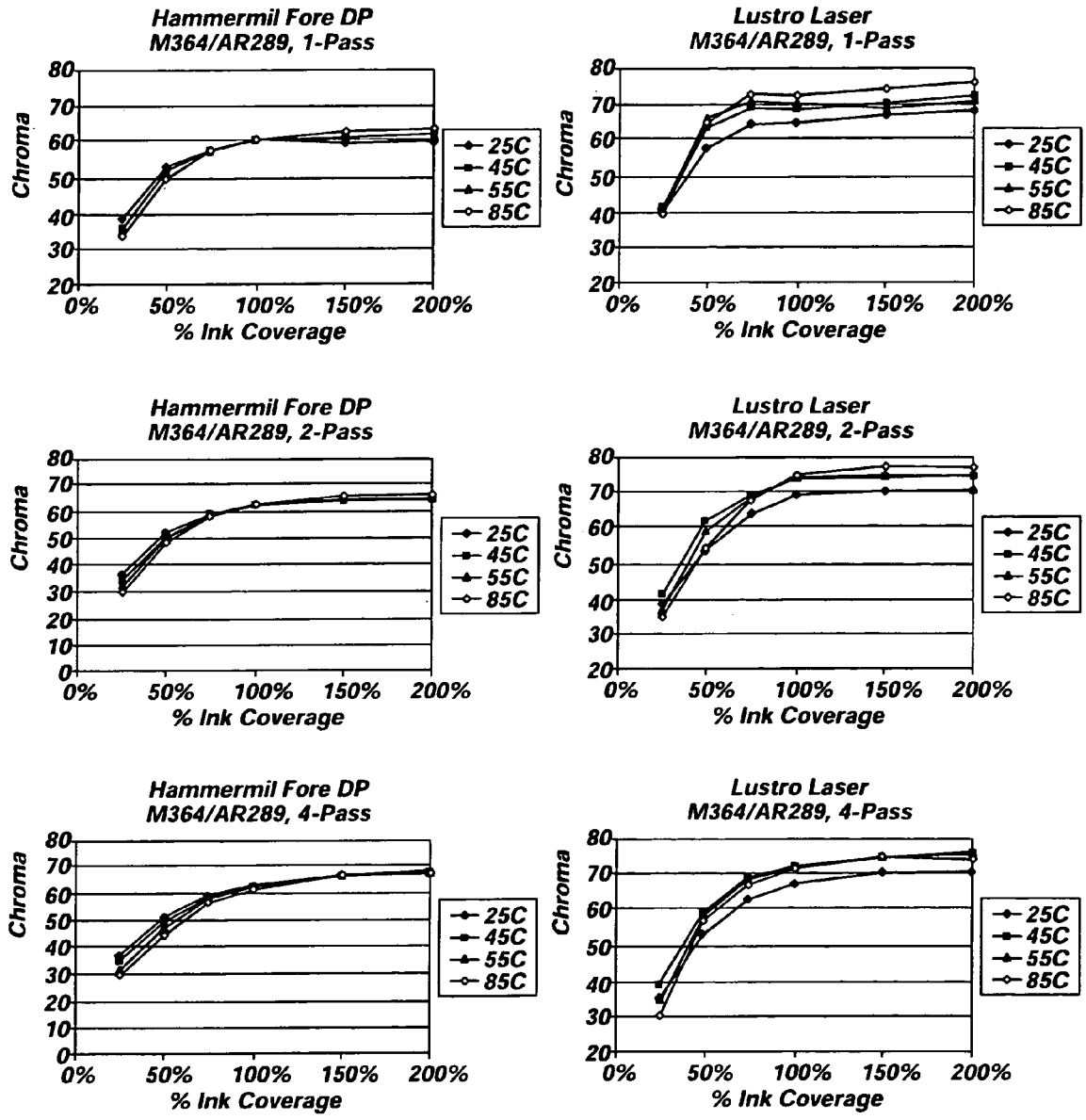
FIG. 5 shows magenta chroma as a function of percent ink coverage on plain paper (left column) and on a commercially coated brochure media (right column) according to an embodiment of the present invention. The effect on chroma with increasing number of passes printing at various print zone temperatures is shown.
Figure 6:
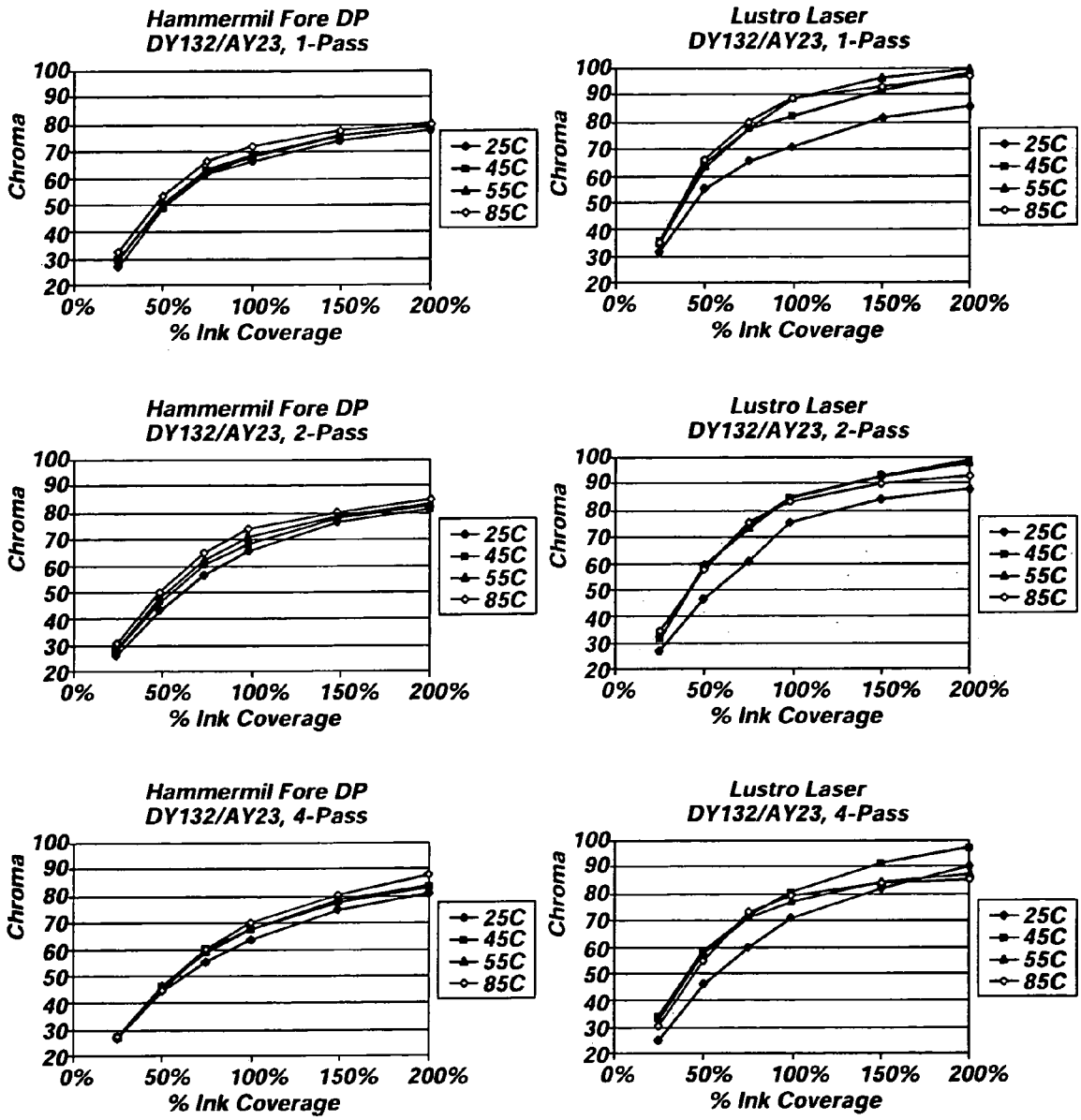
FIG. 6 depicts yellow chroma as a function of percent ink coverage on plain paper (left column) and on a commercially coated brochure media (right column) according to an embodiment of the present invention. The effect on chroma with increasing number of passes printing at various print zone temperatures is shown.

Color chroma as a function of percent ink coverage on plain paper is shown in the left columns of FIGS. 4, 5 and 6 for cyan, magenta and yellow inks, respectively. Generally, higher chroma is associated with increased quality printing. FIG. 4 illustrates that the chroma of cyan was fairly independent of the print zone temperature. FIG. 5 illustrates that a lower temperature gave higher chroma in the low ink coverage region for magenta, but higher temperature gave slightly higher chroma in the high ink coverage region. With yellow, the higher temperature gave higher chroma as shown in FIG. 6. Printing at 55° C. gives similar chroma to printing at 85° C. particularly with multipass printing. However, increasing number of passes generally increased chroma regardless of print zone temperature.

Figure 7:
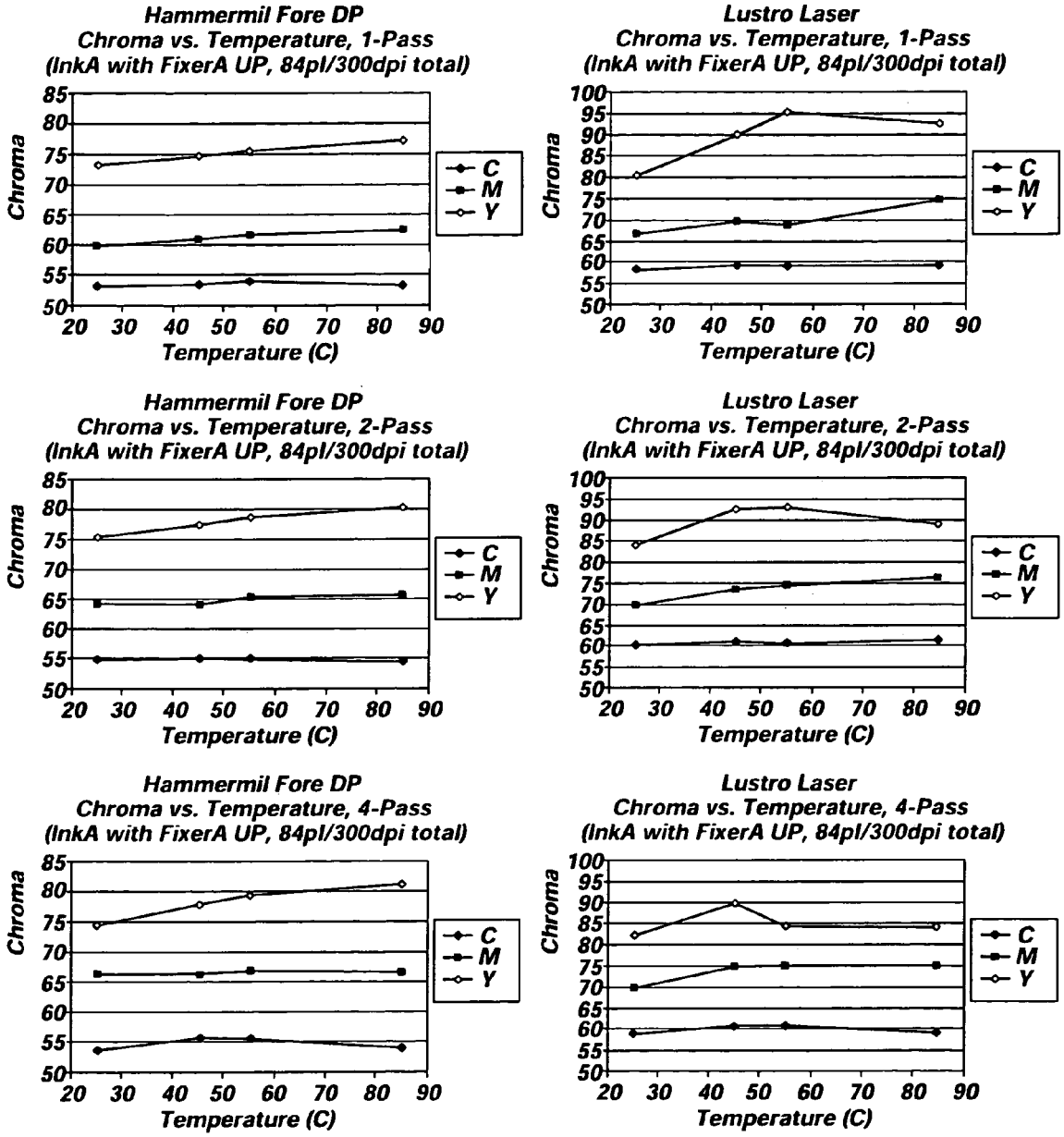
FIG. 7 depicts a snapshot of color chroma at 84 pl/300 dpi (dots per inch) fluid load (ink with fixer) using one-pass (top row), two-pass (middle row) and four-pass (bottom row) print modes according to an embodiment of the present invention. The left column represents comparison on plain paper and the right column represents comparison on a commercially coated brochure media.

The temperature and print mode effects on chroma on plain paper are shown in FIG. 7 (left column) at 84 pl/300 dpi of total fluid load. Cyan was fairly independent of both factors. Roughly 2-3 chroma-unit gain was seen by increasing the temperature to 55° C. with magenta and yellow. Similar chroma gain was seen by increasing the number of passes as well. The effect of temperature and print mode on color chroma appeared to be additive.

Color chroma as a function of percent ink coverage on glossy media is shown in the right columns of FIGS. 4 to 6 for cyan, magenta and yellow inks, respectively. Stronger temperature dependence was seen on Lustro Laser. There was a large chroma increase going from room temperature to 55° C. and, in most cases, chroma at 55° C. was similar to chroma at 85° C.

The temperature and print mode effects on chroma on glossy media are shown in FIG. 7 (right column) at 84 pl/300 dpi of total fluid load. Cyan showed least dependence of both factors. Magenta gained as much as 5 chroma units and yellow gained up to 10 chroma units when printing at 55° C. For yellow, a large increase in chroma was seen going from room temperature to 45° C. and its chroma did not increase significantly with further increase in temperature. Increasing the print zone temperature also accelerated the chroma saturation particularly for magenta and yellow. Thus, higher or equivalent chroma may be obtained with less ink when printing at particular elevated temperatures.

Example 9

Multiple Color Image Quality and Results

Figure 8:
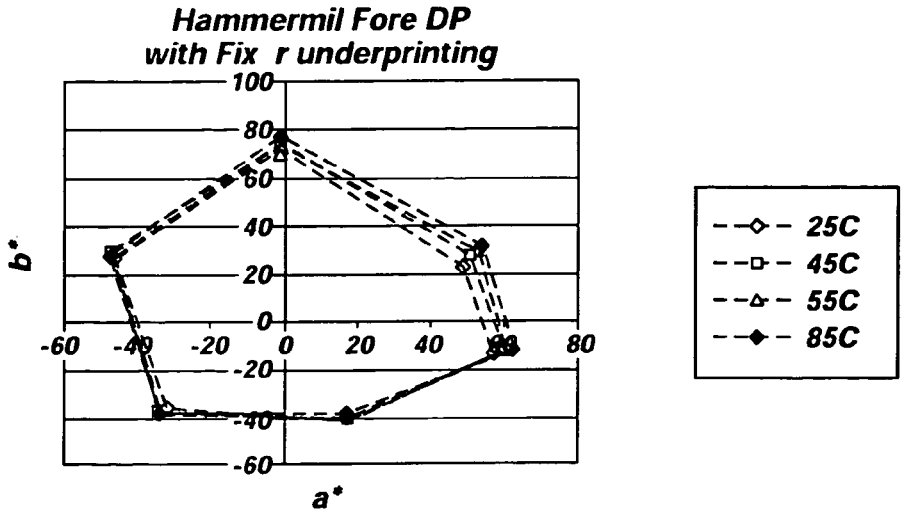
FIG. 8 shows projected L*a*b* area and 8-pt gamut volume as a function of various print zone temperatures on plain paper and a commercially coated brochure media according to an embodiment of the present invention.
Figure 8:
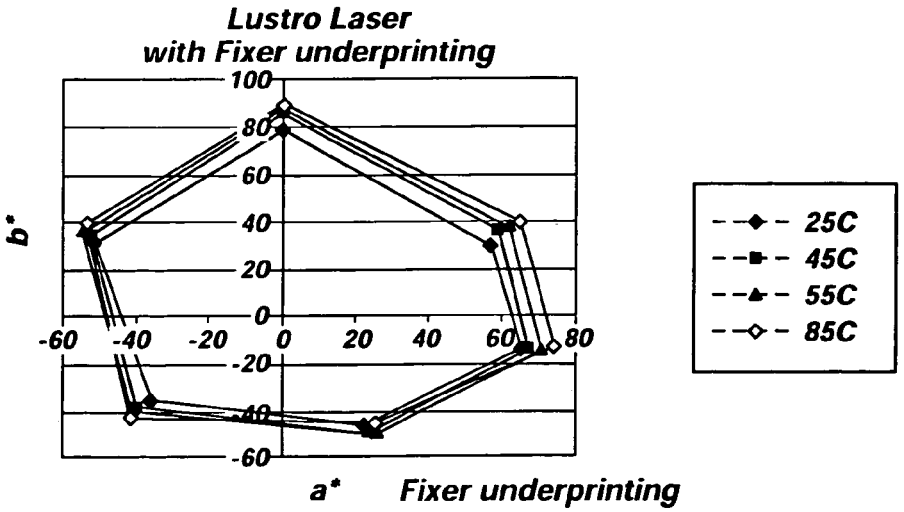
Figure 8:
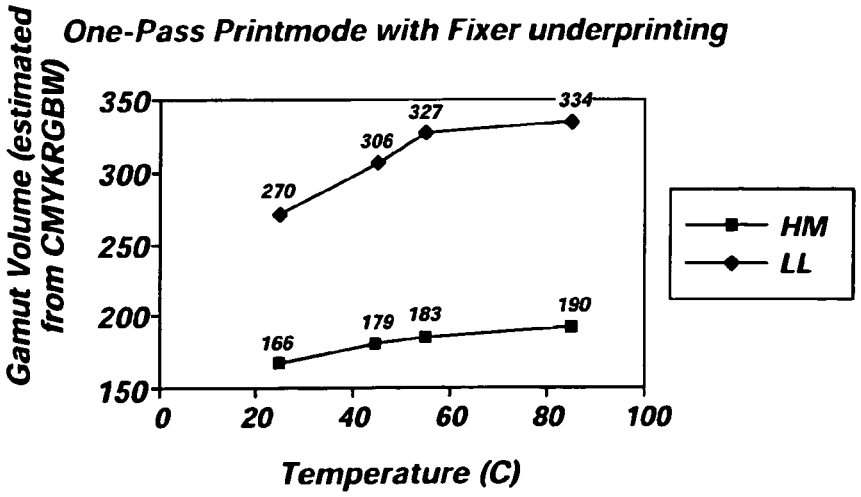
Figure 9:
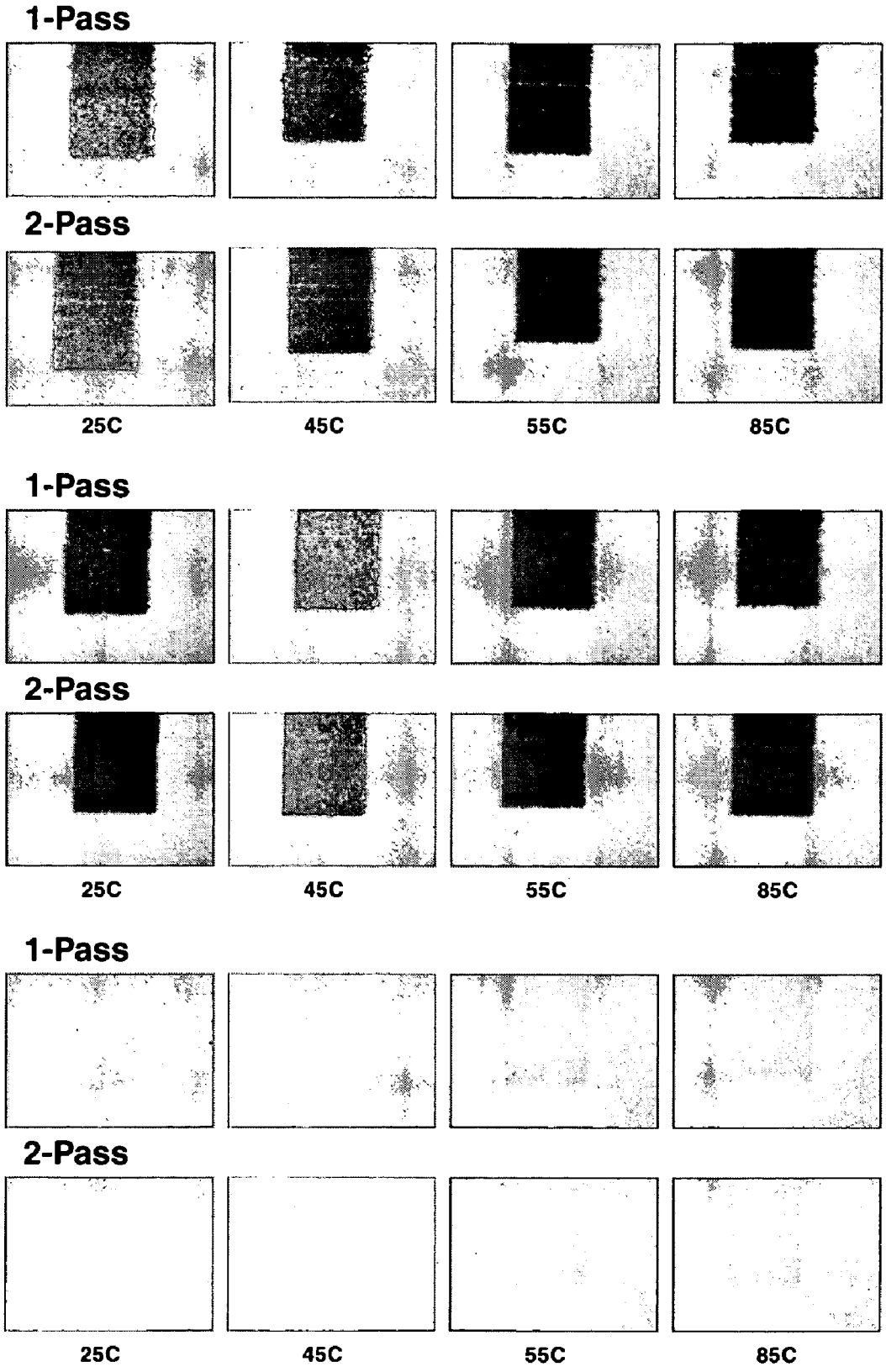
FIG. 9 depicts micrographs of cyan, magenta and yellow inks on plain paper at various print zone temperatures according to an embodiment of the present invention.
Figure 10:
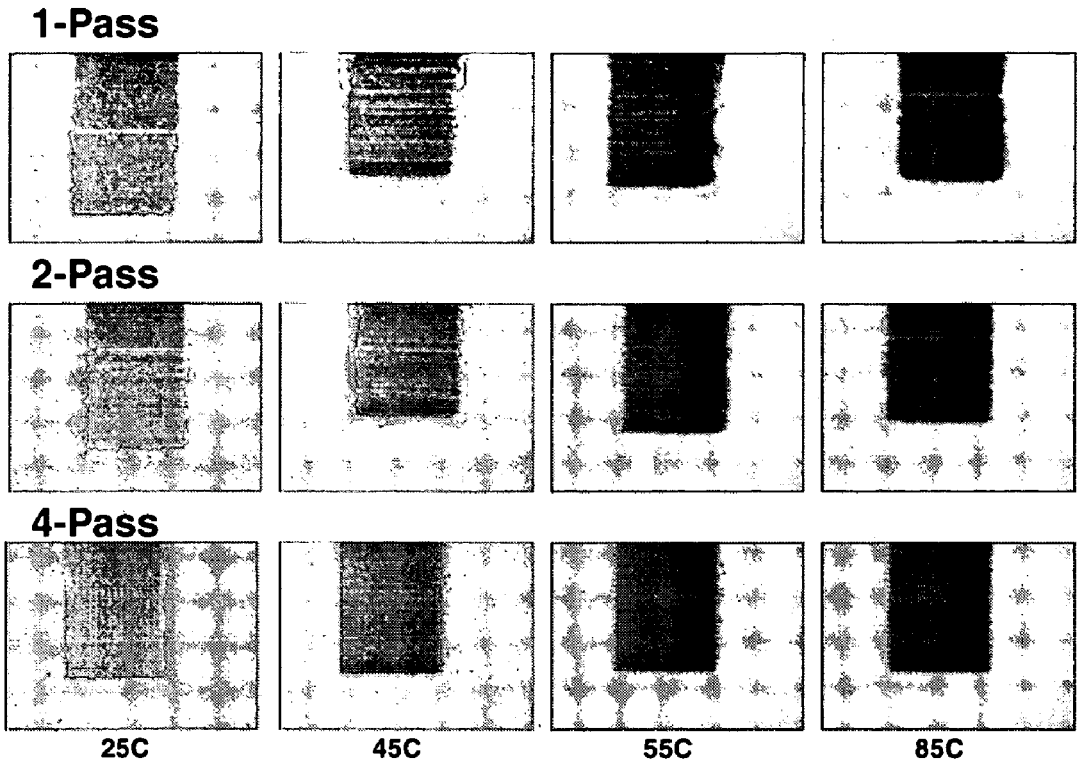
FIG. 10 depicts micrographs of cyan inks on glossy media at various print zone temperatures according to an embodiment of the present invention.
Figure 11:
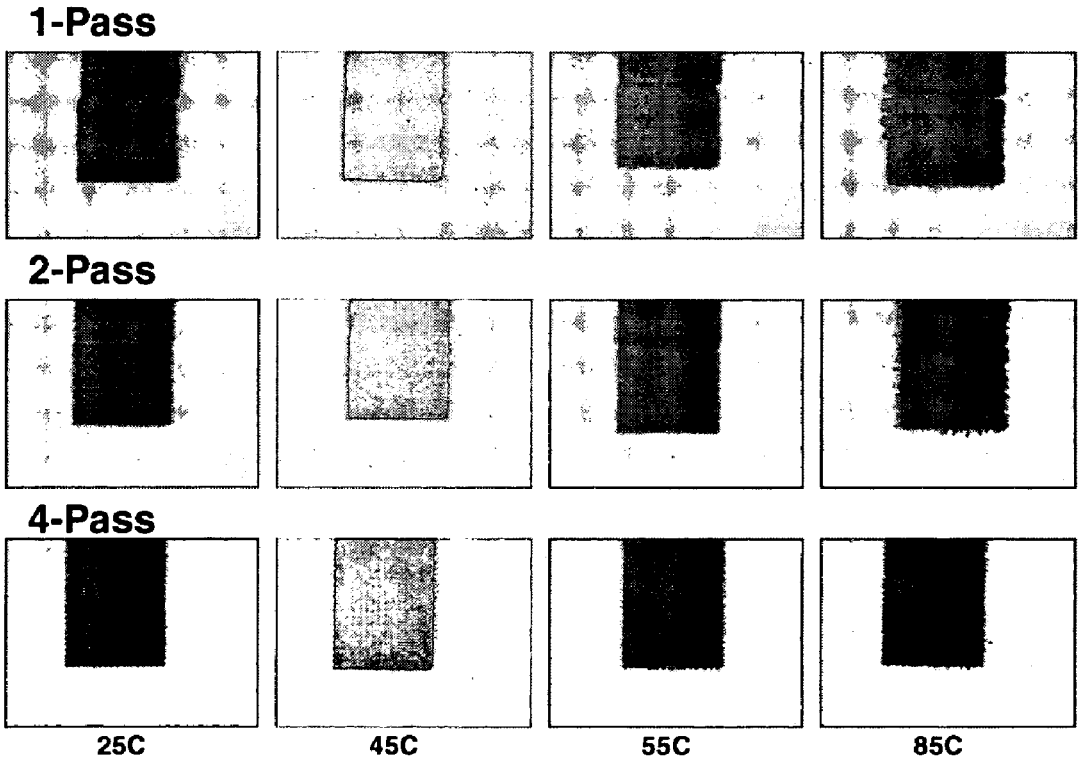
FIG. 11 shows micrographs of magenta inks on glossy media at various print zone temperatures according to an embodiment of the present invention.
Figure 12:
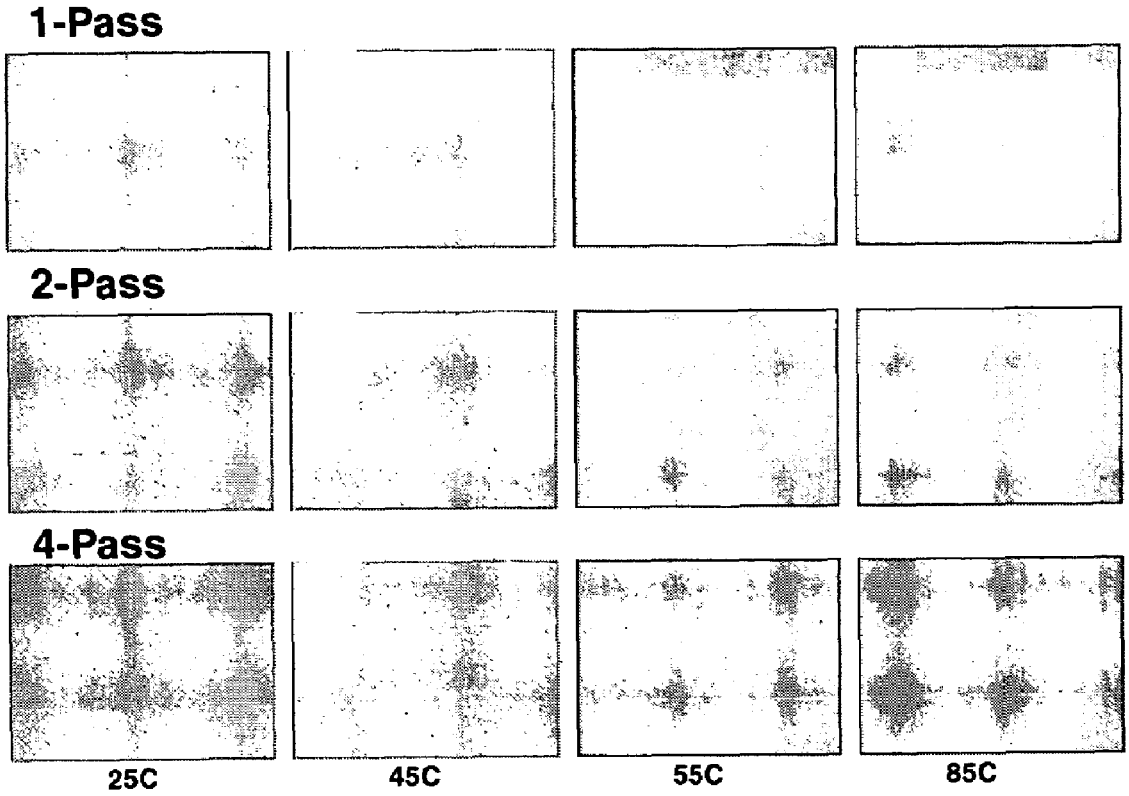
FIG. 12 shows micrographs of yellow inks on plain paper at various print zone temperatures according to an embodiment of the present invention.

The temperature effect on overall color space using a one-pass print mode is shown in FIG. 8. As temperature increased from room temperature (25° C.) to 85° C., the gamut volume increased on both plain paper and glossy media. This effect was more pronounced on a commercially coated brochure media (Lustro Laser). As a result, on Lustro Laser, the overall estimate in gamut volume increased with temperature between 25° C. to 55° C. However, the overall estimate of gamut volume at 55° C. was similar to that at 85° C.

Example 10

Image Edge Quality and Results

Micrographs shown in FIGS. 9, 10, 11 and 12 were obtained by zooming in one of the durability bars. The ink density of the bars was 200% (56 pl/300 dpi of ink) with equal amount of fixer. The durability bars also have two pixels of fixer blooming all around.

Temperature showed other subtle effects on edge quality. On Hammermill® Fore DP paper, elevated temperature degraded the edge quality of cyan slightly. Magenta had slightly better edge quality at 55° C. However, the temperature effect was relatively subtle compared to the effect of print mode. On Lustro Laser, edge quality of cyan and yellow improved with increasing temperature. Edge quality of magenta degraded with increasing temperature.

Without being limited to any particular theory, the subtle effect of temperature may be explained by at least two competitive processes that are temperature dependent. It is believed that there was a decreased precipitation rate with increased temperature which may worsen the edge quality particularly with fixer blooming. The counter effect was increased liquid penetration, dot spreading and drying with increased temperature which is more likely to improve the edge quality. However, both effects work in favor of improving color chroma. On a highly porous media such as Hammermill® Fore DP paper where liquid penetration already dominates without raising the temperature, the effect was very subtle and varied with different inks slightly. On a slow-penetrating media, such as Lustro Laser, a lower edge quality was seen with increasing temperature using one-pass print mode due to slower precipitation rate and higher solubility of the fixer/dye complex in a higher organic environment.

Example 11

Strikethrough Measurements

To determine strikethrough measurements, ink was deposited on plain paper and allowed to soak through. The OD measurements from the back side of the paper were obtained using a MacBeth densitometer. The smaller the reading, the better quality of print image.

Strikethrough was measured without color filters and was media corrected. Strikethrough of ink density at 25, 50, 75, 100, 150 and 200% (7, 14, 21, 28, 42 and 56 pl/300 dpi of ink with equal amount of fixer) was measured. Lustro Laser media was not evaluated for strikethrough due to the high opacity of the media.

Figure 13:
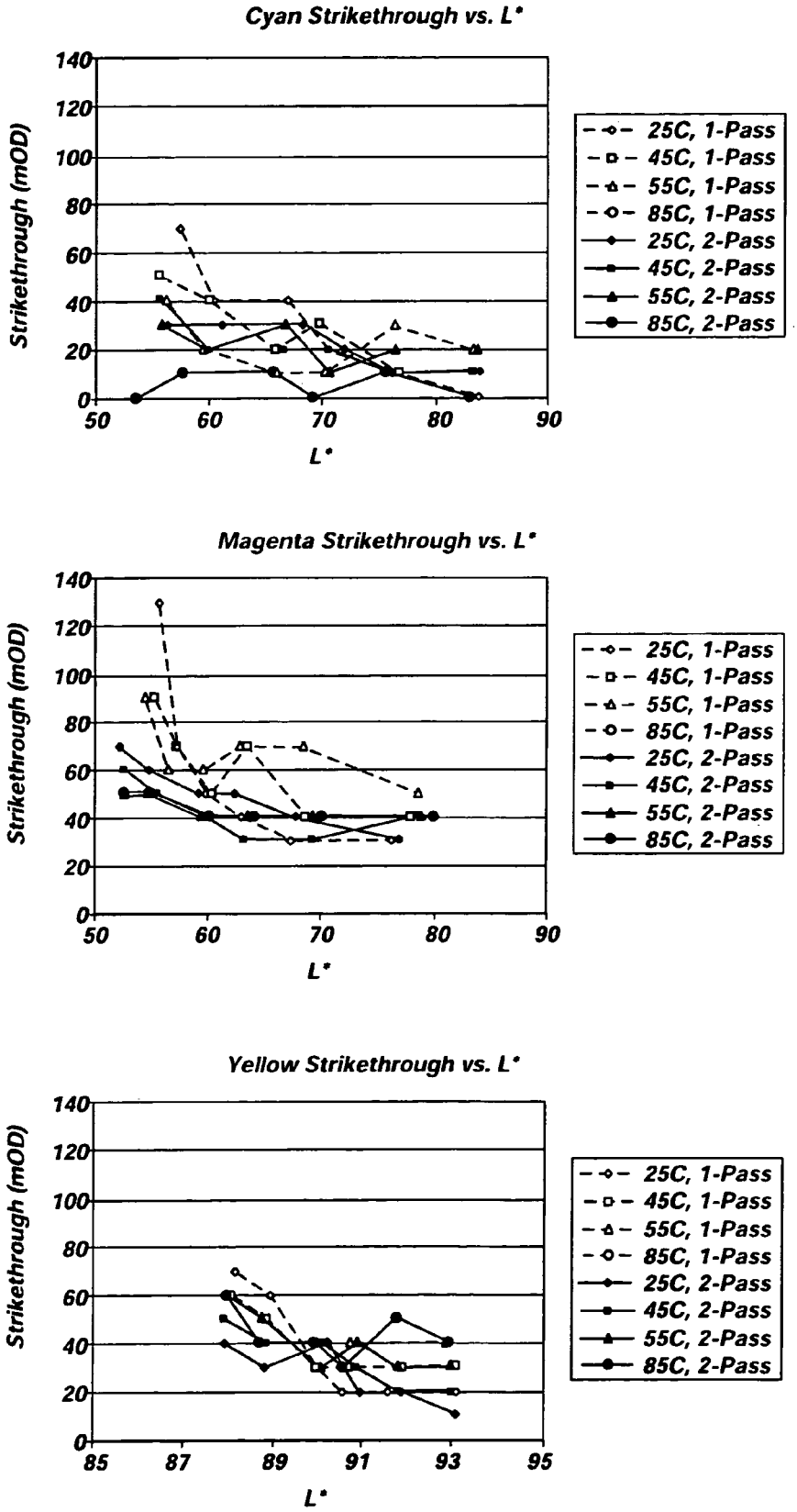
FIG. 13 depicts strikethrough on plain paper as a function of L* of the image for cyan (top), magenta (middle) and yellow (bottom) inks print at various print zone temperatures according to an embodiment of the present invention.

Strikethrough is plotted vs. L* of the image and is shown in FIG. 13. Increasing print zone temperature decreased the strikethrough (30-60 mOD) for cyan and magenta at high ink coverage area using one-pass print mode. No further improvement in strikethrough was seen once the print zone temperature exceeded 45° C. Increasing the number of passes was slightly more effective in reducing the strikethrough. 40 to 70 mOD of decrease in strikethrough was seen going from 1-pass to 2-pass print mode.

Referring to FIG. 13, for cyan, the best strikethrough value was seen at 85° C. and using two-pass printing. Printing at 45° C.-55° C. gave significant improvement in color and strikethrough. The additional heating was also essential in drying the output.

What is claimed is:

1. A method of enhancing color space comprising depositing dye-based ink and charged polymer fixer on a print medium in a print zone having a temperature between about 45° C. and about 85° C., wherein the deposited dye-based ink has a chroma at least two units greater than dye-based ink deposited on an identical print medium at room temperature.

2. The method of claim 1, wherein the print zone has a temperature between about 45° C. and about 55° C.

3. The method of claim 1, wherein the depositing dye-based ink and fixer further comprises underprinting the fixer on the print medium and then depositing the dye-based ink on the print medium.

4. The method of claim 3, further comprising depositing a layer of the fixer over the deposited dye-based ink.

5. The method of claim 1, wherein the print medium comprises either plain paper or a commercially coated brochure media.

6. The method of claim 1, further comprising applying heat to the print zone after the depositing dye-based ink.

7. The method of claim 1, further comprising applying heat to the print zone prior to the depositing dye-based ink and fixer.

8. The method of claim 1, wherein the depositing is effected by one-pass print mode, two-pass print mode or four-pass print mode.

9. A method of inkjet printing, comprising:

underprinting a charged polymer fixer fluid on a plain paper print medium in a print zone;

depositing dye-based ink over the fixer fluid on the plain paper print medium; and heating the print zone during the underprinting and the depositing so that the print zone is at a temperature between about 45° C. and about 85° C. during the underprinting and the depositing.

10. The method of claim 9, wherein the heating of the print zone comprises heating the print zone to a temperature between about 45° C. and about 55° C.

11. The method of claim 9, further comprising depositing a layer of fixer fluid after the depositing of the dye-based ink.

12. The method of claim 9, further comprising applying heat to the print zone after the depositing of the dye-based ink.

13. The method of claim 9, further comprising applying heat to the print zone prior to the underprinting of the fixer fluid.

14. The method of claim 9, wherein the underprinting and the depositing are effected by one-pass print mode, two-pass print mode or four-pass print mode.

15. A printing system capable of maintaining or enhancing chroma independent of increased ink application, the system comprising:

plain paper; and a pen set configured to apply a dye-based ink and a charged polymer fixer to the plain paper in a print zone heated during application of the dye-based ink and the charged polymer fixer the print zone configured to be at a temperature between about 45° C. to about 85° C. during application of the dye-based ink and the charged polymer fixer.

16. The printing system of claim 15, wherein the pen set is configured to underprint the fixer.

17. The printing system of claim 15, wherein the pen set is configured to deposit the fixer over the dye-based ink.

* * * * *